US010378167B1

(12) United States Patent
Mankarious Awad

(10) Patent No.: US 10,378,167 B1
(45) Date of Patent: Aug. 13, 2019

(54) ICE REMOVAL MACHINE

(71) Applicant: Wadie F. Mankarious Awad, Columbia, MD (US)

(72) Inventor: Wadie F. Mankarious Awad, Columbia, MD (US)

( * ) Notice: Subject to any disclaimer, the term of this patent is extended or adjusted under 35 U.S.C. 154(b) by 0 days.

(21) Appl. No.: 16/188,883

(22) Filed: Nov. 13, 2018

(51) Int. Cl.
*E01H 5/08* (2006.01)
*E01H 5/12* (2006.01)

(52) U.S. Cl.
CPC ..... *E01H 5/12* (2013.01); *E01H 5/08* (2013.01)

(58) Field of Classification Search
CPC ..... A01B 45/023; E01H 5/12; E01H 5/08
USPC ..... 37/221, 241, 243; 172/21, 40, 41, 101; 299/25, 41.1
See application file for complete search history.

(56) References Cited

U.S. PATENT DOCUMENTS 1,103,132 A * 7/1914 Deininger ..... F25C 5/043 294/50.5
1,376,741 A 5/1921 Boyle
3,163,236 A * 12/1964 Ray ..... A01B 45/023 172/101
3,180,427 A * 4/1965 Leeper, Jr. ..... A01B 1/243 111/99
4,033,055 A 7/1977 Lazarecky
4,096,915 A * 6/1978 Groth ..... A01B 33/028 172/116
4,164,820 A 8/1979 Krickovich
4,186,967 A * 2/1980 Kuhmonen ..... E01H 5/12 299/25
4,226,034 A 10/1980 Benjamin
4,791,995 A * 12/1988 Hochlan, Jr. ..... A01B 1/06 111/99
4,811,794 A * 3/1989 Greene ..... A01B 11/00 172/240
5,152,348 A * 10/1992 Flanagan, Sr. ..... A01B 45/023 111/99
5,387,778 A 2/1995 Stanger
5,441,116 A * 8/1995 Rodriguez ..... A01B 1/065 172/101
5,520,253 A * 5/1996 Kesting ..... A01B 33/027 172/125
6,675,506 B2 * 1/2004 Pitts ..... E01H 5/12 37/221
7,814,898 B2 10/2010 Rumbaugh
8,428,446 B1 4/2013 Pimental
(Continued)

OTHER PUBLICATIONS

CIP 35—Testing compression , www.nrmca.org/aboutconcrete/cips/35p.pdf.
www.britannica.com Ice crushing force.

*Primary Examiner* — Robert E Pezzuto

(57) ABSTRACT

An ice removal machine provides crushing and removing ice formed on hard surfaces such as sidewalks or external stair steps in front of houses. A rotating pulley wheel fixed on an electric motor generates an oscillation movement for a nailed hammer system. The nails of the hammer system are forced dropping on the ice layer covered a rigid surface; thereby crush the ice into small pieces. The machine is provided by an attached shovel bucket fixed on front of it in order to collect the residual ice and moves it away from the surface. The machine includes a box cart carrier movable by hand and it is provided by front and back wheels and a handle drive that a user holds. The machine is in small reasonable size for private use at home.

5 Claims, 6 Drawing Sheets

(56) References Cited

U.S. PATENT DOCUMENTS

| | | | | |
|---|---|---|---|---|
| 9,206,569 | B1 * | 12/2015 | Roy | B25D 1/16 |
| 9,803,835 | B2 | 10/2017 | Gordon | |
| 1,006,635 | A1 | 9/2018 | Rogers | |
| 2009/0166048 | A1 * | 7/2009 | Wiedenmann | A01B 45/023 172/21 |

* cited by examiner

Cross Sec. I_I

Cross Sec. II-II

ICE REMOVAL MACHINE

References Cited

U.S. Patent Documents

| | | |
|---|---|---|
| 1,376,741 | May 1919 | Boyle |
| 4,033,055 | July 1977 | Lazarecky |
| 4,164,820 | August 1979 | Krickovich |
| 4,226,034 | October 1980 | Benjamin |
| 5,387,778 | February 1995 | Stanger |
| 7,814,898 | October 2010 | Rumbaugh |
| 8,428,446 | April 2013 | Pimentel |
| 9,803,835 | October 2017 | Gordon |
| 10,066,352 | September 2018 | Rogers |

BACKGROUND OF THE INVENTION

1. Field of the Invention

The present invention relates to Ice Removal Machine, and, more particularly, to a handy small machine for removing ice formed on roads, sidewalks and stairs.

2. Description of the Prior Art

Ice formation on road, sidewalks and stairs is a problem of considerable concern. Ice forms a slippery layer which creates a hazardous walking and driving conditions which often lead to accidents; these accidents may result in personal injuries such as broken wrist or broken ankle, but more serious injuries such as hip fracture or skull fracture can also occur.

Maintaining sidewalks and external stair steps in front of homes during the winter months can be a very difficult task to accomplish due to accumulation of ice or snow formed by rain and freezing temperature. A slip and fall accident may occur due to ice patches in commercial parking lots, stairs on family houses, sidewalks and driveway in apartment complexes which may result in liability that falls on the property owner or the person responsible for maintenance that he failed to keep the property in a reasonably safe condition.

Traditional methods for removing ice or preventing ice formation is by shoveling or spreading salt mixed with chemicals on the surface.

There are multiple inventions that focused on the ice formation problem and how to remove it from different surfaces. These inventions presented multiple approaches with some focusing on improving manual shovels and others utilizing heating methods to melt the formed ice. U.S. Pat. No. D711704 focused on removing ice formation using an improved manual shovel design while U.S. Pat. No. 4,900,891 presented an invention for ice removal using a laser beam to remove ice formed on airplane wings surface. There are also U.S. patent Ser. No. 10/066,352 and U.S. Pat. No. 5,387,778 which presented devices to remove snow and ice from roadways and sidewalks utilizing heating elements.

While these devices fulfill their respective, particular objectives and requirements, the aforementioned patents do not describe an ice removal machine that may be easily transported and assembled by a user, low maintenance and readily adapted on a variety of surfaces and small areas, such as sidewalks and external home stairs.

Therefore, it can be appreciated that there exists a continuing need for an inexpensive, easy to use Ice Removal Machine which can be used by the residential and commercial property owners to crush and remove ice from sidewalks and external home stairs. In this regard, the present invention substantially fulfills this need.

SUMMARY OF THE INVENTION

In accordance with the present invention, the Ice Removal Machine is used to remove ice from different surfaces including but not limited to sidewalks and stairs in houses. The machine includes an electrical motor that generates power to rotate a pulley wheel drive connected by a free rod linked to a movable steel plate. The movable steel plate contains anti-rust steel nails which will be called herein after as the "hammer system". The vertical oscillation movement of the hammer system crushes the ice layer formed on the concrete. The machine includes a shovel bucket to remove the crushed ice away from the target surface and may further include an integrated system to dispose the crushed ice in a vacuum system or a blower assembly to remove the crushed ice away from the target surface.

BRIEF DESCRIPTION OF THE DRAWINGS

The present invention will be better understood when read in light of the accompanying drawings in which.

DESCRIPTION OF THE PREFERRED EMBODIMENT

Figure 1:
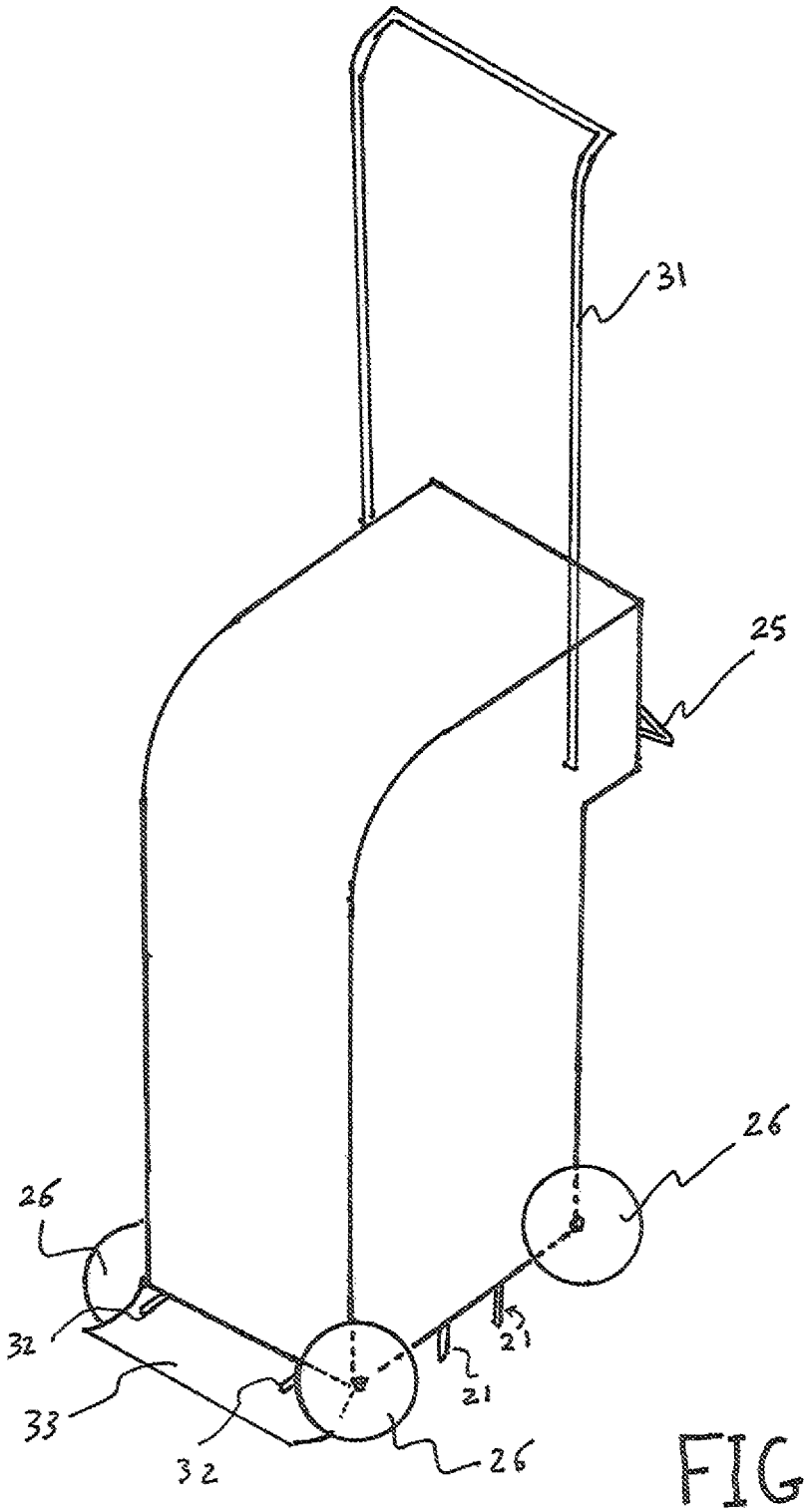
FIG. 1 is a general isometric view of the present invention.

FIG. 1 illustrates a general view of an exemplary embodiment of the ICE Removal Machine according to the disclosure attached thereto. Within this disclosure, the term "ice" includes any form of frozen precipitation on surfaces, including, but not limited to snow, ice, freezing rain or hail.

Figure 2:
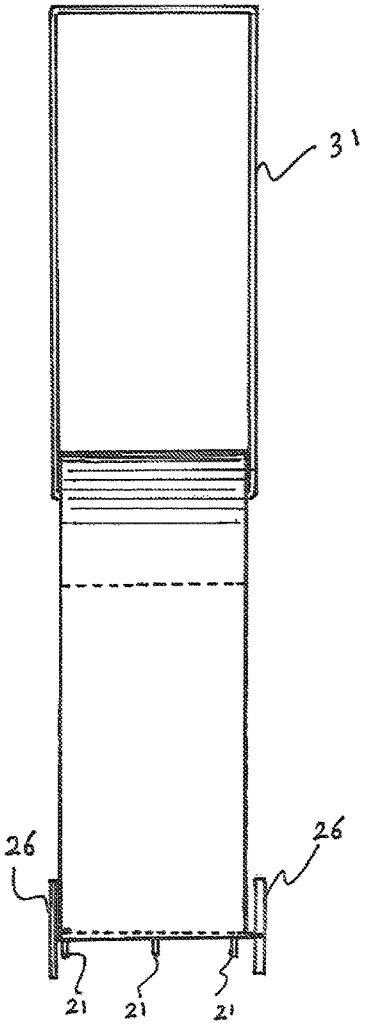
FIGS. 2, 3 and 4 are elevation, side view and a plan of the present invention.
Figure 3:
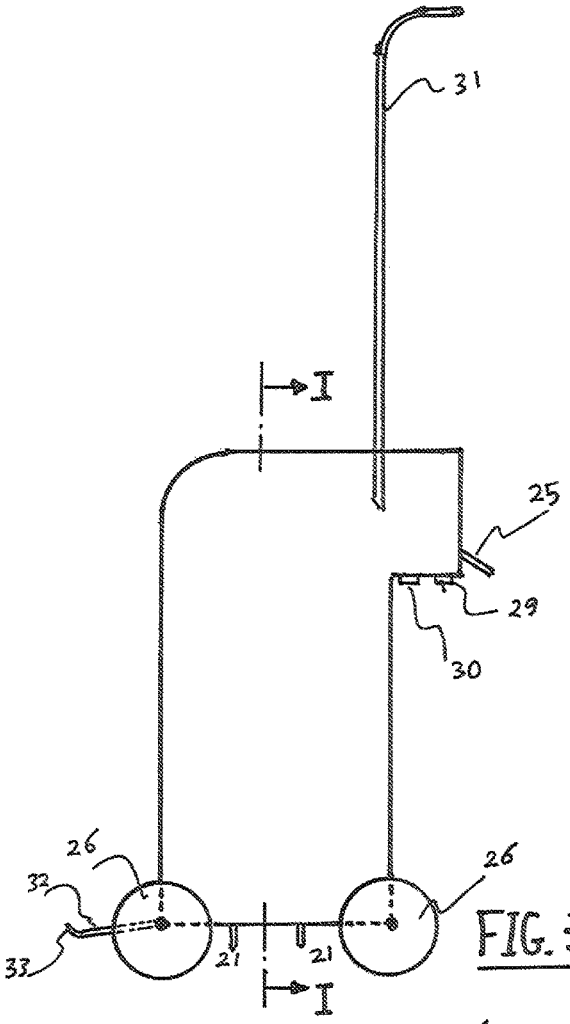
Figure 4:
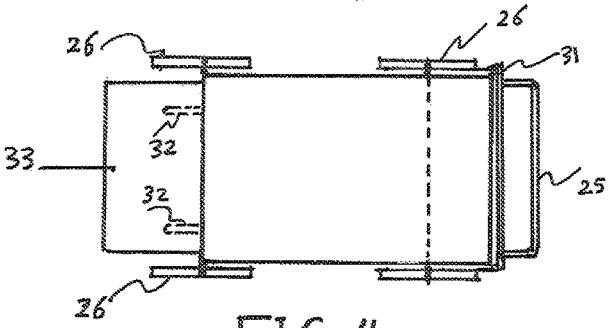

FIGS. 2-4 illustrate the detailed views of the Ice Removal Machine showing the two main effective parts; the anti-rust steel nails 21 which are responsible for crushing the ice and the front shovel bucket responsible for pushing the crushed ice away from the target surface. In addition, figures illustrate the brake hand 25 used to disconnect power to the machine motor to stop the hammer system oscillation and pushes the rod lever 24 up to direct the shovel bucket 33 and bucket hooks 32 down to push the crushed ice away from the target surface. As shown in FIG. 3 the power input 30 is the connection to the power cable and the switch on/off 29 is used to switch the machine power on or off. The Ice Removal Machine has four wheels 26 and is pushed manually using handle drive 31.

Figure 5:
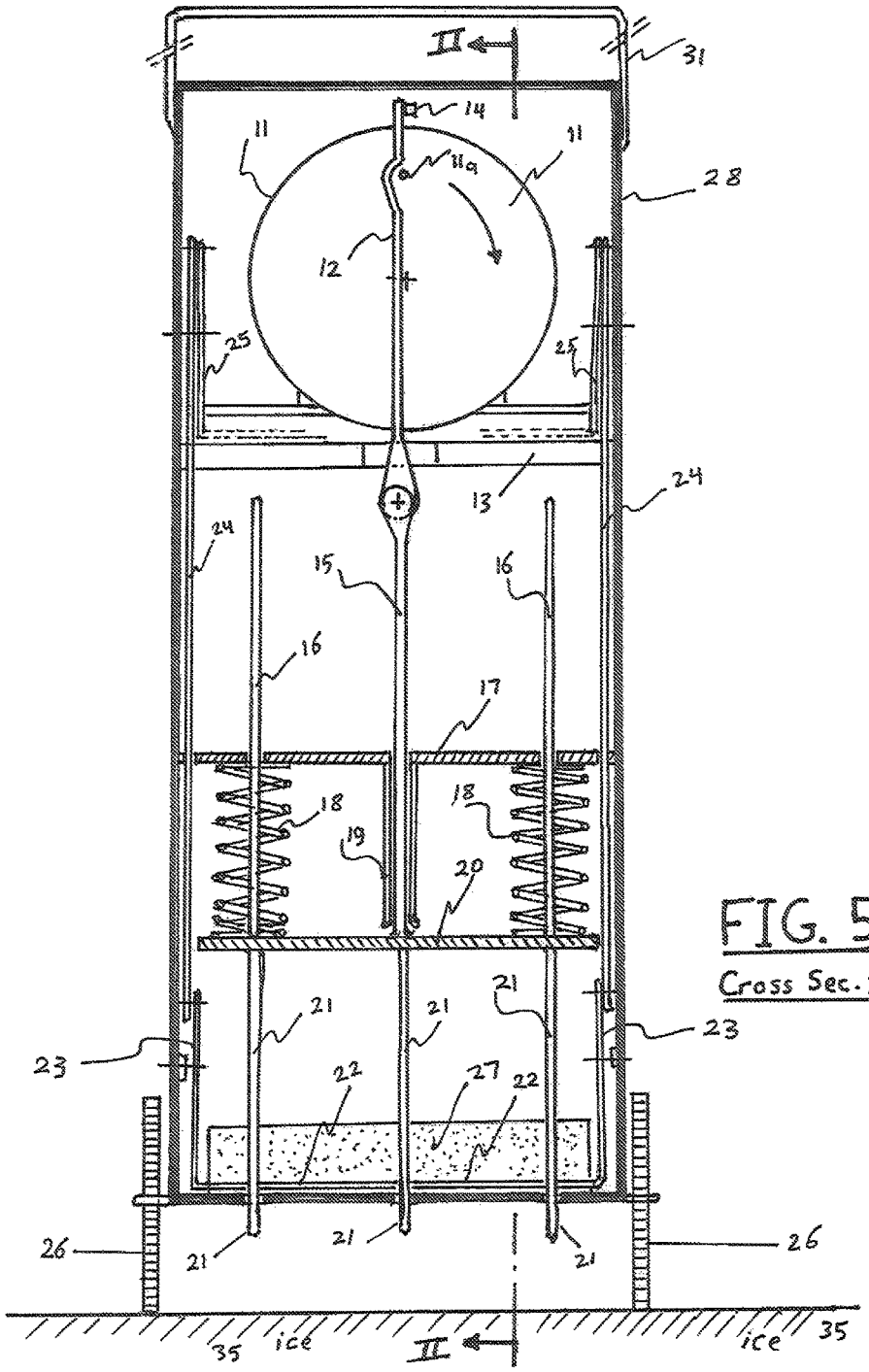
FIG. 5 is an enlarged elevation view at cross section I-I shown in FIG. 3.
Figure 7:
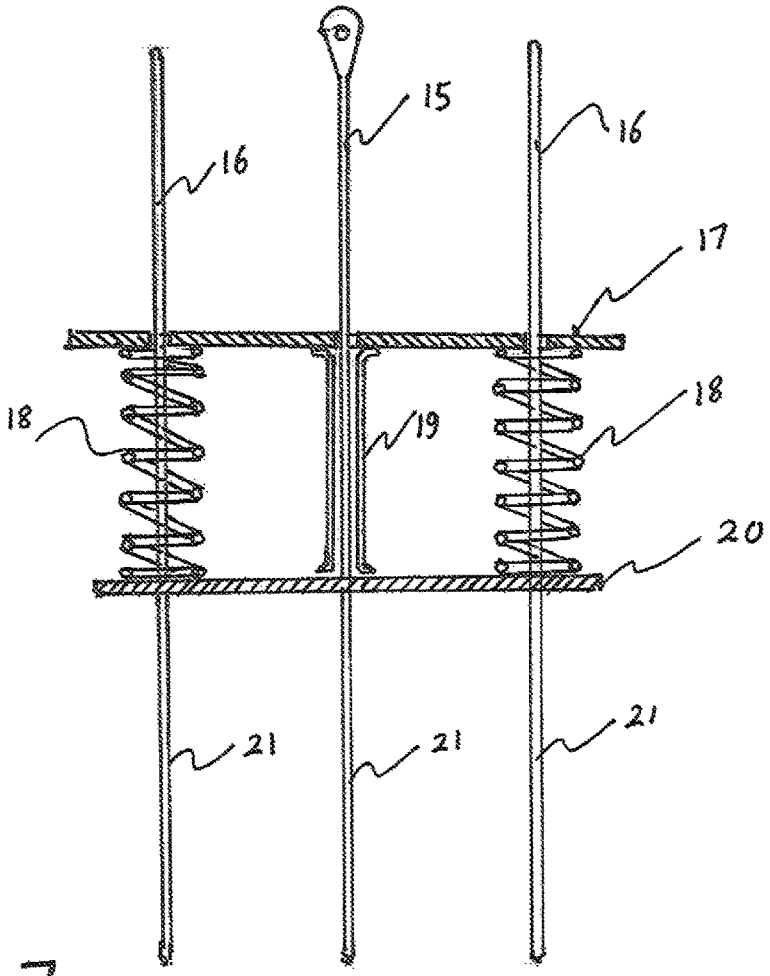
FIGS. 7 and 8 illustrate elevation and plan views of the hammer system main parts that are used to crush the ice layer formed on the surface.
Figure 8:
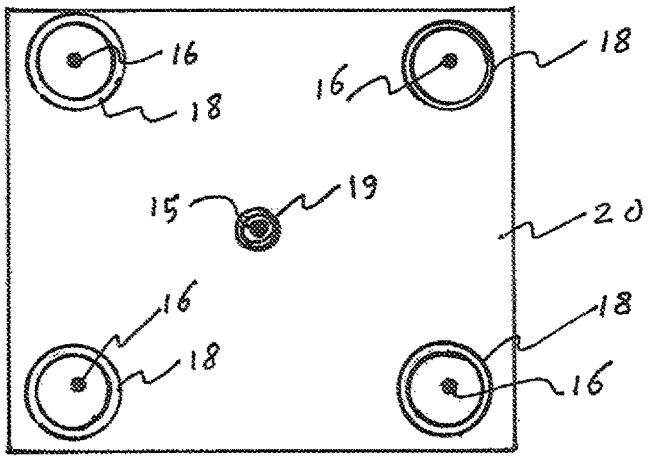

FIG. 5 shows the details of the inside view of the Ice Removal Machine at cross section I-I as shown on FIG. 3, the figure illustrates the main parts of the machine and how they interact together. The hammer system as shown in details in FIGS. 7 and 8 shows the anti-rust steel sharp edge nails 21 attached to the movable plate 20 and responsible for ice crushing process. The plate 20 is vertically connected to transfer rod 15 hinged with pedal rod 12 which is used to transfer the oscillating motion. In order to keep a vertical oscillation of the plate 20 and nails 21; plate 20 moves vertically guided by four fixed rods 16 passing through holes in the fixed plate 17. In addition, transfer rod 15 moves vertically inside a vertical guide cylinder 19 connected to plate 17.

Figure 6:
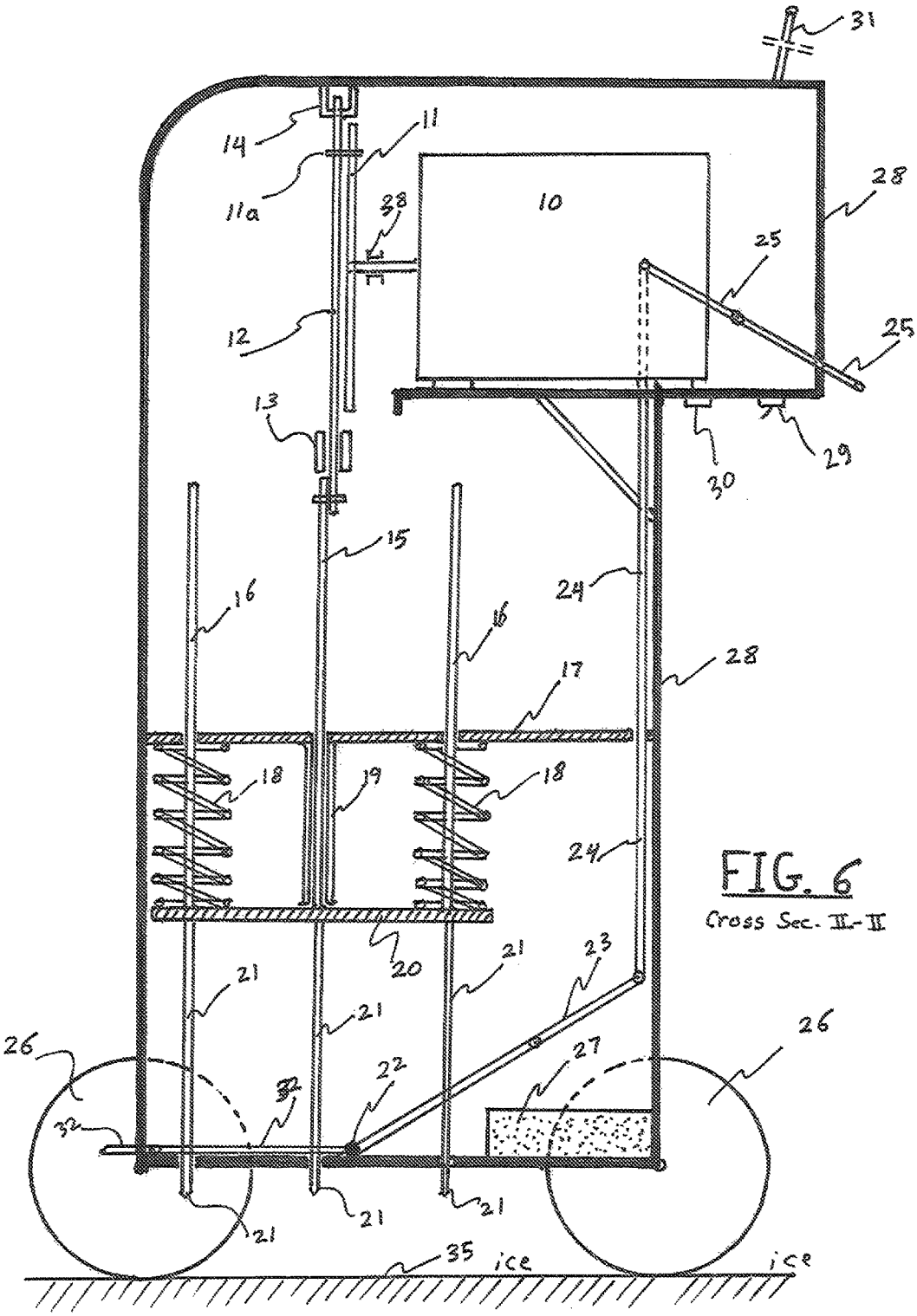
FIG. 6 is an enlarged side view at cross section II-II shown in FIG. 5.
Figure 9:
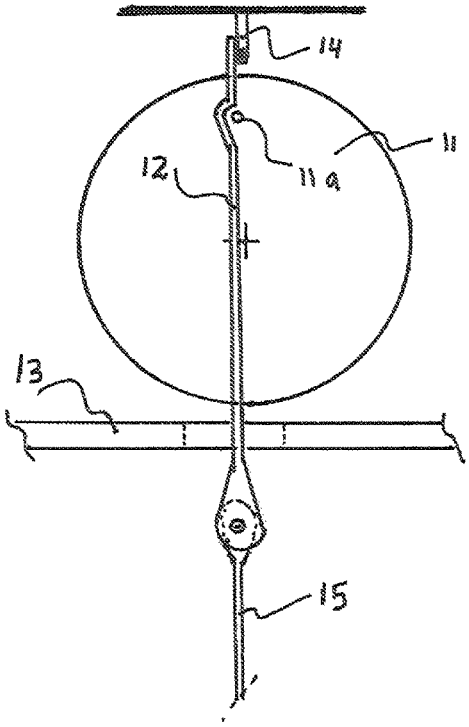
FIGS. 9 and 10 illustrate an elevation and a plan views of the pulley wheel and the oscillation mechanism of the hammer system of the present invention.
Figure 10:
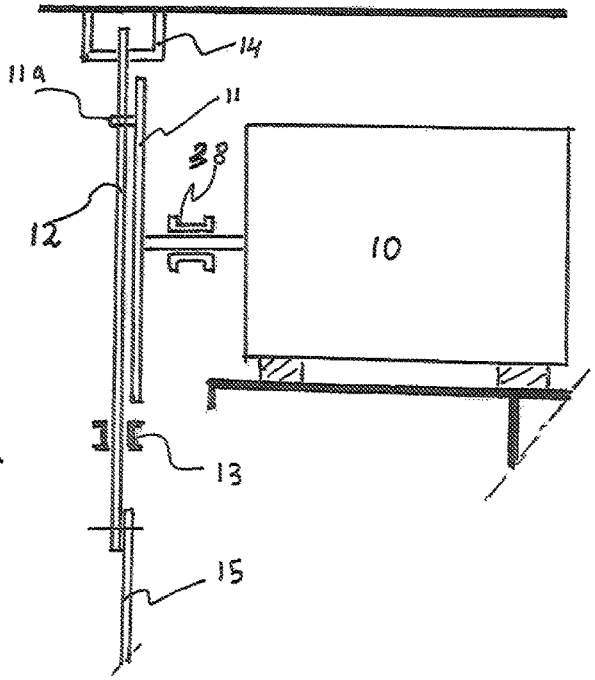

FIG. 6 is another detailed inside view of the Ice Removal Machine, it shows cross section II-II on FIG. 5. FIG. 6 demonstrates the power components producing the oscillating force. FIGS. 9 and 10 in conjunction with FIG. 6 show the details of the power source components. Electrical motor 10 gets the electric power from the input source 30 through the switch 29. The pulley wheel 11 is connected to the electrical motor 10 by an axis rod running inside a fixed pillow block bearing 38. Pedal rod 12 has a hook shape at one end and the other end is connected with the transfer rod 15 through bearing axis. When the motor starts, the fixed pin 11*a* on the pulley wheel 11 pulls the pedal rod 12 up to the level of the fixed stopper 14. When the pedal rod 12 touches the fixed stopper 14, it releases freely from pin 11*a* causing pedal rod 12 and the hammer system connected through the transfer rod 15 to drop vertically down. This vertical drop is amplified by the force generated by four compression springs 18. The pedal rod 12 movement is guided trough slot rod 13. Compression springs 18 are compressed when transfer rod 15 moves up and when the pedal rod 12 touches the fixed stopper 14 the compression springs 18 decompress producing force that pushes down the hammer system through transfer rod 15 resulting in crushing the ice layer 35.

As shown in FIGS. 5 and 6, brake hand 25 has multiple functions; moving the brake hand 25 up or down moves lever rod 24 vertically which connects to lever rod 23; this movement consequently pushes brake rod 22 up, prevent plate 20 from moving downward and pushes the the two bucket hooks 32 holding the bucket upward. The upward movement of the two bucket hooks 32 will lower down the other end where the shovel bucket 33 is connected. Shovel bucket 33 function is to remove the crushed ice away from the target surface. Moving the brake hand 25 down results in disconnecting power to motor 10 to save energy and avoid any damage to the hammer system.

Since sidewalks and outside home stairs are usually made of cast concrete, it is very important to protect the concrete surface from any damages during the ice crushing process. The force generated by decompression of springs 18 and the system weight is designed to not exceed the force needed to crush the ice layer 35. The mechanical properties of both ice and concrete are as follows: the typical strength value for crushing in bars for ice is 551 psi (38 bars) and concrete compression strength is 2500 psi (172.4 bars).

As illustrated in FIGS. 5 and 6, an added balance weight 27 is used to keep the machine from moving upward when the hammer system is pushed down to crush the ice layer 35.

The external body 28 of the Ice Removal Machine is made of anti-rust material. The Ice Removal Machine rests on four wheels 26 and can be pushed using handle drive 31.

What is claimed as being new and desired to be protected by Letter Patent of the United States is as follows:

1. An ice removal machine for crushing and remove ice, comprising:

a. A machine body frame having at least two wheels rotatably attached to the machine body frame;

b. A hammer mechanism system mounted within the machine body frame including:

i. A fixed plate attached to the machine body frame;

ii. A movable plate located below the fixed plate;

iii. A plurality of sharp edge nails attached to the bottom surface of the movable plate;

iv. Four springs contacting near the edges of the fixed plate and the movable plate;

v. A transfer rod attached to the movable plate and extending through an opening in the fixed plate;

vi. A pedal rod having a first end attached to the transfer rod and a second end having a hook;

vii. A motor having an axis rod attach to a pulley wheel; and viii. A pin located on the edge of the pulley wheel that engages the hook on the pedal rod wherein the rotation of the motor causes the pin to engage and disengage the hook on the pedal rod to cause the movable plate with the nails to compress the springs to cause the nails to move up and down in a hammering motion.

2. The ice removal machine according to claim 1 further comprising a front bucket attached to the front of the machine body frame.

3. The ice removal machine according to claim 1 further comprising a brake system including; a control lever that shuts off the motor and raises the movable plate with the nails.

4. The ice removal machine according to claim 3 wherein the control lever further engages a link to bucket hooks in order to extend the bucket attached to the front of the machine body frame.

5. The ice removal machine according to claim 1 further comprising a balance weight located within the machine body frame.

* * * * *